US006305996B1

(12) United States Patent
Detwiler

(10) Patent No.: US 6,305,996 B1
(45) Date of Patent: Oct. 23, 2001

(54) VARIABLE HEIGHT OUTBOARD MOTOR MOUNT

(75) Inventor: Timothy P. Detwiler, Coatesville, PA (US)

(73) Assignee: Detwiler Industries Incorporated, Morgantown, PA (US)

( * ) Notice: Subject to any disclaimer, the term of this patent is extended or adjusted under 35 U.S.C. 154(b) by 0 days.

(21) Appl. No.: 09/560,261

(22) Filed: Apr. 26, 2000

(51) Int. Cl.[7] ..... B63H 20/08
(52) U.S. Cl. ..... 440/53; 248/641; 440/59
(58) Field of Search ..... 248/640, 641; 440/53, 58, 59, 60, 61

(56) References Cited

U.S. PATENT DOCUMENTS

| | | | |
|---|---|---|---|
| 2,928,630 | 3/1960 | Wisman . | |
| 2,928,631 | 3/1960 | Hartman . | |
| 3,242,899 | 3/1966 | Hanson . | |
| 4,232,627 | 11/1980 | Glenn et al. | 440/61 |
| 4,482,330 | 11/1984 | Cook | 440/2 |
| 5,484,311 | 1/1996 | Detwiler | 440/61 |
| 5,791,954 | 11/1998 | Johnson | 440/112 |
| 5,944,568 * | 8/1999 | Rabal | 440/53 |
| 5,964,627 | 10/1999 | Detwiler | 550/58 |

OTHER PUBLICATIONS

GMC Power Lift brochure; Cook Manuf. Co., Duncan, OK 1987.

Model–600 brochure; Hydro–Electric Transom; Land & Sea, North Salem, NH (Date Unknown).

* cited by examiner

*Primary Examiner*—Sherman Basinger
(74) *Attorney, Agent, or Firm*—Howson & Howson

(57) ABSTRACT

A manually adjustable outboard motor mount comprises two bracket assemblies, one being attachable to a boat transom and the other being adapted to support an outboard motor. The motor bracket assembly is constrained to movement in a straight, substantially vertical path relative to the transom bracket assembly by the cooperation of interengaging ribs and recesses on the brackets. The brackets, which have their ribs on their outer faces and their recesses on their inner faces, can be formed from a single extrusion. Cross braces fit into the recesses on the inner faces of the brackets.

8 Claims, 4 Drawing Sheets

16
76
14
18
80
78
22
26
28
24
74
70
3
64
3
66
20
12
32
30
10
34

16
76
14
18
74
78
22
80
24
20
12
10

VARIABLE HEIGHT OUTBOARD MOTOR MOUNT

SUMMARY OF THE INVENTION

This invention relates to improvements in marine propulsion systems. It is specifically concerned with improvements in an apparatus for varying the height of an outboard motor on the transom of a boat.

Cavitation is a common problem with marine propulsion systems. Boat motors tend to draw water from the surface, which allows air as well as water to pass through the propeller. This results in cavitation or slippage of the propeller, reducing the efficiency of operation of the motor.

It is therefore important to avoid cavitation when operating marine propulsion systems, such as motor boat propellers. Outboard engines normally include a cavitation plate to prevent cavitation. This plate should be positioned to travel across the surface of the water while the motor is operating. At this location, the cavitation plate prevents air from reaching the propeller.

The height at which a cavitation plate is most effective varies depending upon various factors. A boat operating at low speeds, but requiring maximum thrust, will perform best when the cavitation plate is positioned one to three inches above the bottom of the boat. At higher speeds, however, the stern is lower in the water, and the optimum position for the cavitation plate is typically three to five inches above the bottom of the boat.

My U.S Pat. No. 5,484,311, issued Jan. 16, 1996, describes a variable height outboard motor mount comprising brackets connected respectively to a boat transom and an outboard motor, a fluid actuator for adjusting the relationship between the two frames, and guides comprising rods with vertically spaced bearings for firmly constraining the brackets to relative movement in a straight line.

The motor mount of U.S Pat. No. 5,484,311 has the advantage that it allows the outboard motor to be set to any selected height from a remote location by a closed-loop servo control. However, it also has the disadvantage that it is primarily designed for racing, and is more elaborate and expensive than necessary for fishing or pleasure boats. Height adjustment for improved operating efficiency is nevertheless desirable in the operation of fishing and pleasure boats.

The cost of a variable height outboard motor mount having the advantages of strength afforded by the guide construction described in U.S Pat. No. 5,484,311 can be reduced by eliminating the servo control system, and providing for manual adjustment. However, in a manually controlled outboard motor mount utilizing a hydraulic actuator system any fluid leakage in the actuator, or in its associated pump or valving can permit drift in the height of the outboard motor. Other schemes for manual adjustment can be used, but all are subject to drift as a result of the strong vibrations inevitably accompanying outboard motor operation. The foregoing problems are addressed in my U.S Pat. No. 5,964,627, dated Oct. 12, 1999. However, the outboard motor mount described in U.S Pat. No. 5,964,627 also utilizes rods with vertically spaced bearings for firmly constraining the parts of the motor mount to relative movement in a straight line. The rod and bearing assembly is highly effective for maintaining a rigid relationship between the relatively moving parts of the motor mount, and for providing the strength needed to support very heavy and powerful outboard motors. However, the rods and bearings are expensive and difficult to assemble.

There is a need, therefore, for a simpler and less expensive, variable height outboard motor mount which is capable of withstanding the heavy loads imparted by the weight of the motor and its thrust, and maintaining a rigid relationship between the outboard motor and the boat transom. Accordingly, among the important objects of the invention are cost saving, simplicity of manufacture, ability to withstand heavy loads, and rigidity.

Briefly, the motor mount in accordance with the invention utilizes brackets with cross-braces as its principal structural parts. The brackets have interengaging ribs and recesses to constrain its parts to relative movement in a straight path.

More specifically, the motor mount in accordance with the invention comprises first and second bracket assemblies one being connectible to a boat transom and the other being adapted to support an outboard motor. A screw, a hydraulic mechanism, or other suitable manual or powered actuator is connected to the first and second bracket assemblies for effecting movement of the second bracket assembly relative to the first bracket assembly along a path which is substantially vertical when the one bracket assembly is mounted on the transom of a boat. The first bracket assembly comprises first and second brackets, each having a inner face and an upper and lower end, a first cross brace connected to the first and second brackets adjacent to their upper ends and a second cross brace connected to the first and second brackets adjacent to their lower ends. The second bracket assembly comprises third and fourth brackets, each having an outer face and an upper and lower end, a third cross brace connected to the third and fourth brackets adjacent to their upper ends and a fourth cross brace connected to the third and fourth brackets adjacent to their lower ends. The third and fourth cross braces are situated between the first and second cross braces and the spacing between the third and fourth cross braces is substantially less than the spacing between the first and second cross braces so that the bracket assemblies can move relative to each other through a range in the substantially vertical path. The outer face of the third bracket is engaged with the inner face of the first bracket and the outer face of the fourth bracket is engaged with the inner face of the second bracket. The engaging inner and outer faces of the brackets have interengaging ribs and recesses constraining the bracket assemblies to relative movement along the substantially vertical path.

In a preferred embodiment, the inner face of at least one of the first and second brackets, and preferably the inner face of each, has a recess elongated in the direction of the substantially vertical path. Each recess has a side surface extending transverse to the inner face of its bracket, and the outer face of the engaging bracket has a rib also elongated in the direction of the path. The rib has a side surface extending transverse to the outer face of its bracket. The side surfaces are in sliding engagement with each other and prevent relative movement of the engaging brackets in at least one direction which is both parallel to their respective inner and outer faces and transverse to the direction of the substantially vertical path.

The interengagement of the ribs and recesses of the brackets provides the motor mount with a high degree of strength and the capability of withstanding the weight and thrust of a large, powerful outboard motor, without the need for the rod and bearing structure of U.S Pat. Nos. 5,484,311 and 5,964,627.

Ends of the first and second cross braces are preferably received in the recesses of the first and second brackets, with faces of the first and second cross braces in engagement with side surfaces of the recesses. The cross braces are constrained by side surfaces of the recesses against movement in directions which are both parallel to the inner faces of the first and second bracket and transverse to the substantially vertical path. Taking advantage of the recesses of the brackets to receive ends of the cross braces provides an exceptionally strong bracket assembly.

In the preferred embodiment, screws extend through the first and second brackets in directions perpendicular to the inner faces of the first and second brackets adjacent to the upper and lower ends thereof. The screws adjacent to the upper ends of the first and second brackets are threaded into the first cross brace, and the screws adjacent to the lower ends of the first and second brackets are threaded into the second cross brace.

In the preferred embodiment, each of the first and second brackets has a slot extending from its outer face to its inner face, the slot being elongated in the direction of the substantially vertical path. Elongated bars are situated respectively against the outer faces of the first and second brackets, and each bar has a rib slidably fitting into a slot. Two screw fasteners extend through each bar and through an adjacent one of the slots, and are threaded into an adjacent one of the third and fourth brackets. The ribs further contribute to the ability of the motor mounts to withstand the forces imparted to them by the weight and thrust of large, powerful outboard motors.

In the preferred embodiment, the first and second brackets also have uniform and identical cross-sections, in planes to which the substantially vertical path is perpendicular, from a location above the upper end of each slot to a location below the lower end of each slot, except for interruption by the slots. The third and fourth brackets have cross sections, in planes to which the substantially vertical path is perpendicular, which are uniform and identical to the uniform cross-sections of the first and second brackets, from locations adjacent to the third cross brace to locations adjacent to the fourth cross brace. Thus, the brackets can all be produced from a single extrusion.

Other objects, details and advantages of the invention will be apparent from the following detailed description when read in conjunction with the drawings.

DETAILED DESCRIPTION

The outboard motor mount in accordance with the invention is similar in many respects to the motor mount described in my U.S. Pat. Nos. 5,484,311 and 5,964,627, and accordingly the disclosures of those patents are here incorporated by reference. The principal features that distinguish my present invention from the outboard motor mounts described in my prior patents, and from other adjustable outboard motor mounts, are: the interengaging configuration of the brackets which allows the motor mount to withstand very heavy loads; the cost saving achieved by the elimination of expensive rod and bearing assemblies, and by virtue of the fact that the interengaging brackets are formed from identical extrusions; and the rigidity afforded by the interlocking relationship between the brackets and the cross braces that connect opposite brackets together.

Figure 1:
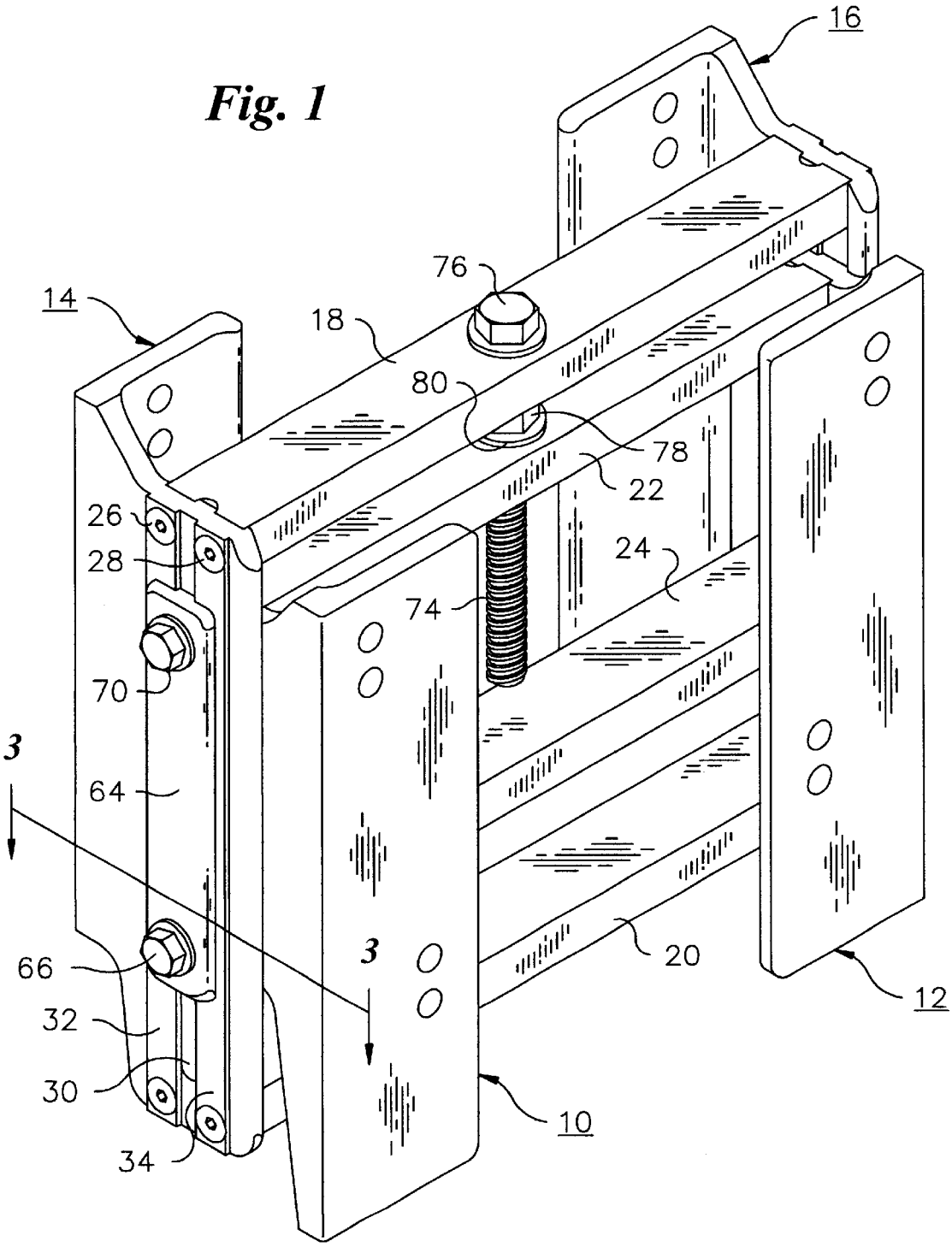
FIG. 1 is a perspective view, showing the variable height outboard motor mount in a lowered condition.

As shown in FIG. 1, the outboard motor mount in accordance with the invention comprises four brackets, each having a generally L-shaped horizontal cross-section. A pair of generally L-shaped brackets 10 and 12 is adapted to be secured to the transom of a boat, and a pair of generally L-shaped brackets 14 and 16 is adapted to support an outboard motor. Brackets 14 and 16 are rigidly secured together by upper and lower cross braces 18 and 20, and brackets 10 and 12 are rigidly secured together by cross braces 22 and 24. Cross braces 22 and 24 are both located between cross braces 18 and 20. Thus, brackets 14 and 16, together with cross braces 18 and 20, constitute the principal parts of a first bracket assembly, and brackets 10 and 12, together with cross braces 22 and 24, constitute the principal parts of a second bracket assembly.

Cross brace 18 is connected to bracket 14 by socket-type cap screws 26 and 28, which are countersunk into bracket 14 so that they are flush with the outer face of the bracket. Cross brace 18 is also connected to bracket 16 by similar countersunk cap screws (not shown), and the other cross braces are connected to their respective brackets in a similar fashion.

The brackets are formed as extrusions, preferably of stainless steel, and have the same basic cross-sectional shape when extruded. The upper and lower ends of brackets 14 and 16 are cut away to eliminate excess material in order to reduce the overall weight of the device. The upper and lower ends of brackets 10 and 12 are cut away so that they can move vertically between cross braces 18 and 20. Cutting can be carried out by any of various process, for example, plasma torch cutting.

A vertically elongated slot 30 is milled in bracket 14, and a corresponding slot (not shown) is milled in abracket 16.

Figure 3:
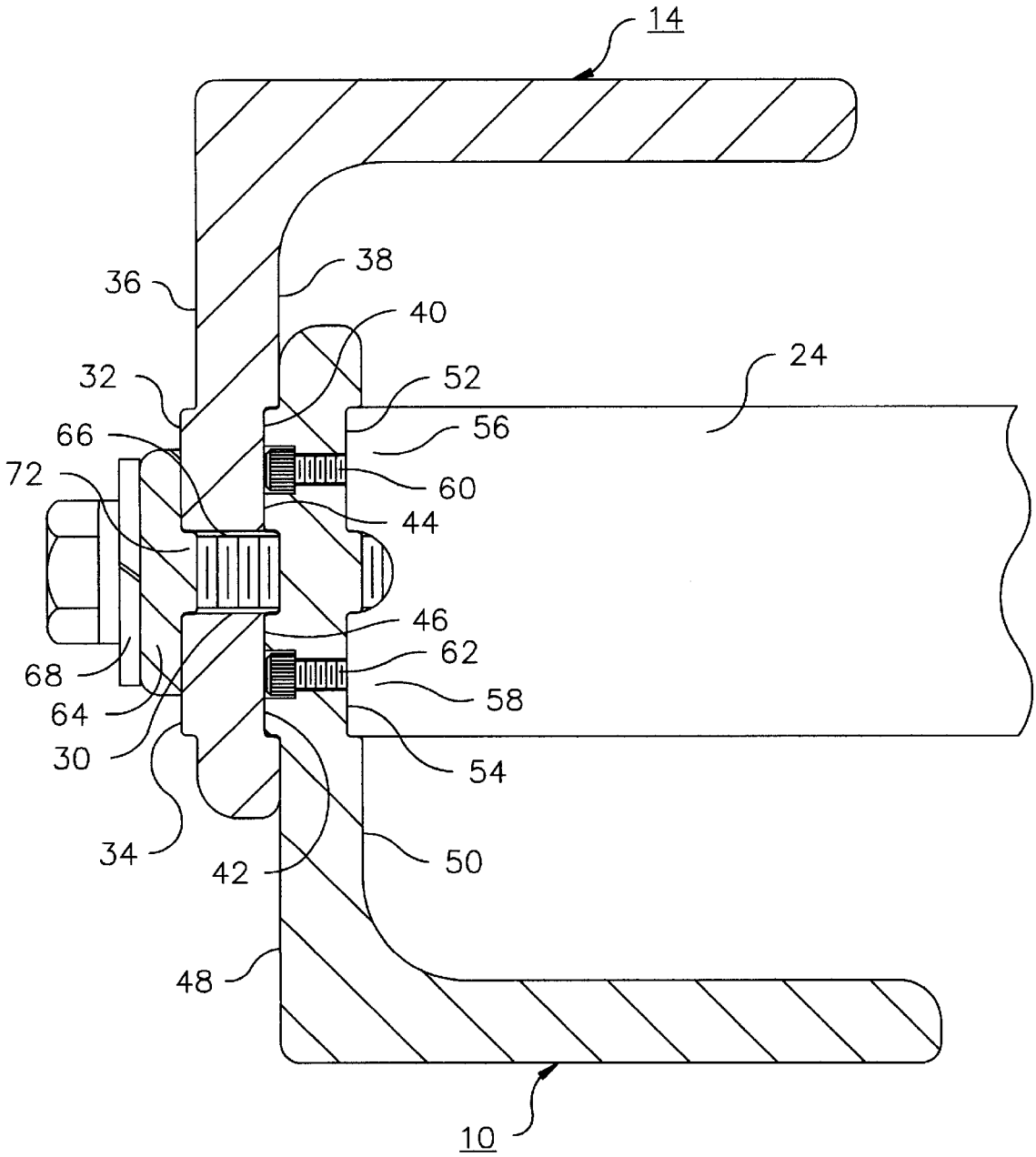
FIG. 3 is a fragmentary horizontal section taken on plane 3—3 in FIG. 1 but showing fasteners connecting a bracket to a cross brace.

The similar cross-sections of brackets 10 and 14 are best shown in FIG. 3. Bracket 14 has a pair of elongated ribs 32 and 34 on its outer face 36. The ribs are parallel to each other and situated on opposite sides of slot 30. The inner face 38 of bracket 14 is recessed at 40 and 42 to receive ribs 44 and 46 on the outer face 48 of bracket 10. The inner face 50 of bracket 10 is recessed at 52 and 54 to receive end projections 56 and 58 of cross brace 24. The side surfaces of the recesses are engaged by side surfaces of the brackets so that the cross braces are constrained against movement in directions mutually parallel to the inner faces of the brackets and transverse to the path of relative movement of the bracket assemblies.

Cross brace 24 and bracket 10 are secured together by countersunk cap screws 60 and 62. A bar 64, having a T-shaped cross-section, is connected to bracket 10 by a bolt 66, which extends through slot 30 and is threaded into bracket 10 between ribs 44 and 46. The bolt may also extend into cross brace 24. A washer 68 is provided under the head of the bolt. The T-shaped bar 64, is also connected to bracket 10 by a second bolt 70, as shown in FIG. 1.

As shown in FIG. 3, because of the slot 30, the inner face 38 has a continuous recess rather than two separate recesses. The outer side surfaces of ribs 44 and 46 are positioned so that they engage the inner side surfaces of the recess, allowing bracket 14 to slide relative to bracket 10 along a path extending in the lengthwise direction of the ribs, but preventing relative movement in directions transverse to the lengthwise direction of the ribs but parallel to the faces of the brackets. Thus the engagement of a side surface of rib 44 with a side surface of the recess prevents relative movement of the brackets in one direction that is both parallel to the respective inner and outer faces of brackets 14 and 10 and transverse to the lengthwise direction of the ribs. Similarly the engagement of a side surface of rib 46 with the opposite side surface of the recess prevents relative movement of the brackets in the opposite direction.

The bolts 66 and 70 are tightened sufficiently to hold bar 64 against ribs 32 and 34 but are not made so tight as to prevent the bracket 14 from sliding along bracket 10. A rib 72 on bar 64 fits into slot 30 and assists the interengaging ribs 44 and 46 in preventing any relative movement of the brackets other than longitudinal sliding.

The relationship of parts at the locations of bolt 70 and the two bolts (not shown) on the opposite side of the device of FIG. 1 is substantially as depicted in FIG. 3.

Figure 2:
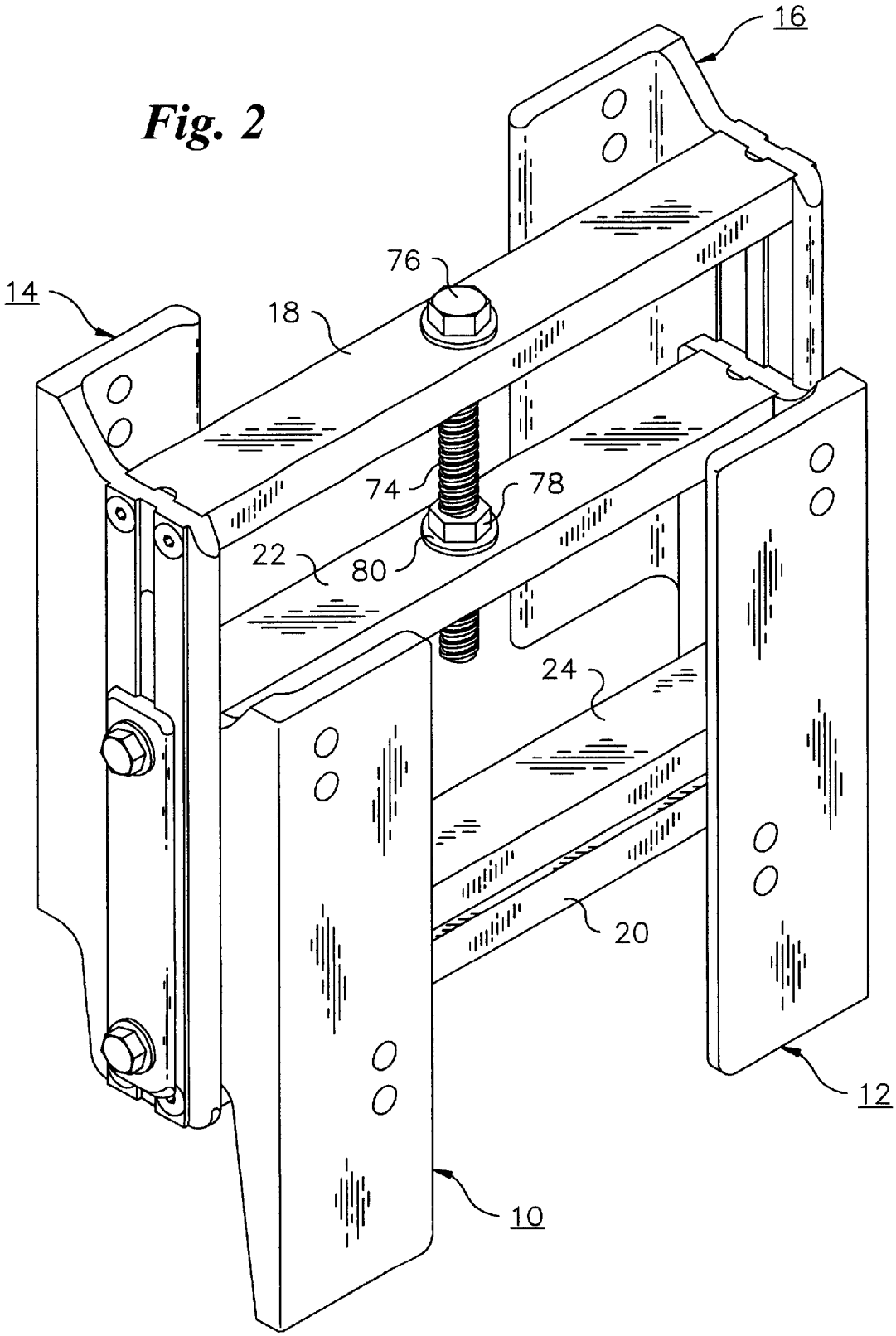
FIG. 2 is a similar perspective view, showing the motor mount in a raised condition.

A screw 74, having a head 76 is journalled in cross brace 18 and threaded in cross brace 22. The manner in which screw 74 is journalled in cross brace 22 is substantially as depicted in my U.S. Pat. No. 5,964,627. By applying a wrench to head 76, the screw can be rotated to raise or lower the outboard motor attachment assembly comprising brackets 14 and 16 and cross braces 18 and 20. Thus, the outboard motor attachment assembly can be raised from the lowered position depicted in FIGS. 1 and 4 to the raised position depicted in FIG. 2. It can be locked at the raised position, the lowered position, or any intermediate position, by tightening nut 78 against washer 80, thereby increasing the friction between the threads of screw 74 and the internal threads (not shown) in cross brace 22.

The interengagement of brackets 10 and 14 and of brackets 12 and 16 eliminates the need for the expensive rod and bearing assemblies utilized in the outboard motor mounts of U.S. Pat. Nos. 5,484,311 and 5,964,627 while providing the high degree of strength and rigidity needed to support the weight and withstand the thrust of a high-powered outboard motor. The interlocking relationship between the cross braces and the recesses of the brackets also contributes to the strength and rigidity of the mount.

As pointed out above, except for interruption by their slots, brackets 14 and 16 have uniform cross-sections from locations above the upper ends of the slots to locations below the lower ends of the slots. Brackets 10 and 12 have cross sections, from locations adjacent to cross brace 22 to locations adjacent to cross brace 24, which are uniform and identical to the uniform cross-sections of brackets 14 and 16. Thus, the interengaging brackets can all be produced from a single extrusion, and a significant reduction in manufacturing costs can be realized.

Various modifications can be made to the outboard motor mount described. For example, optionally, nut 76 can be provided with a crank, and nut 78 can be provided with arms, as in U.S. Pat. No. 5,964,627, thereby eliminating the need for a wrench.

Figure 4:
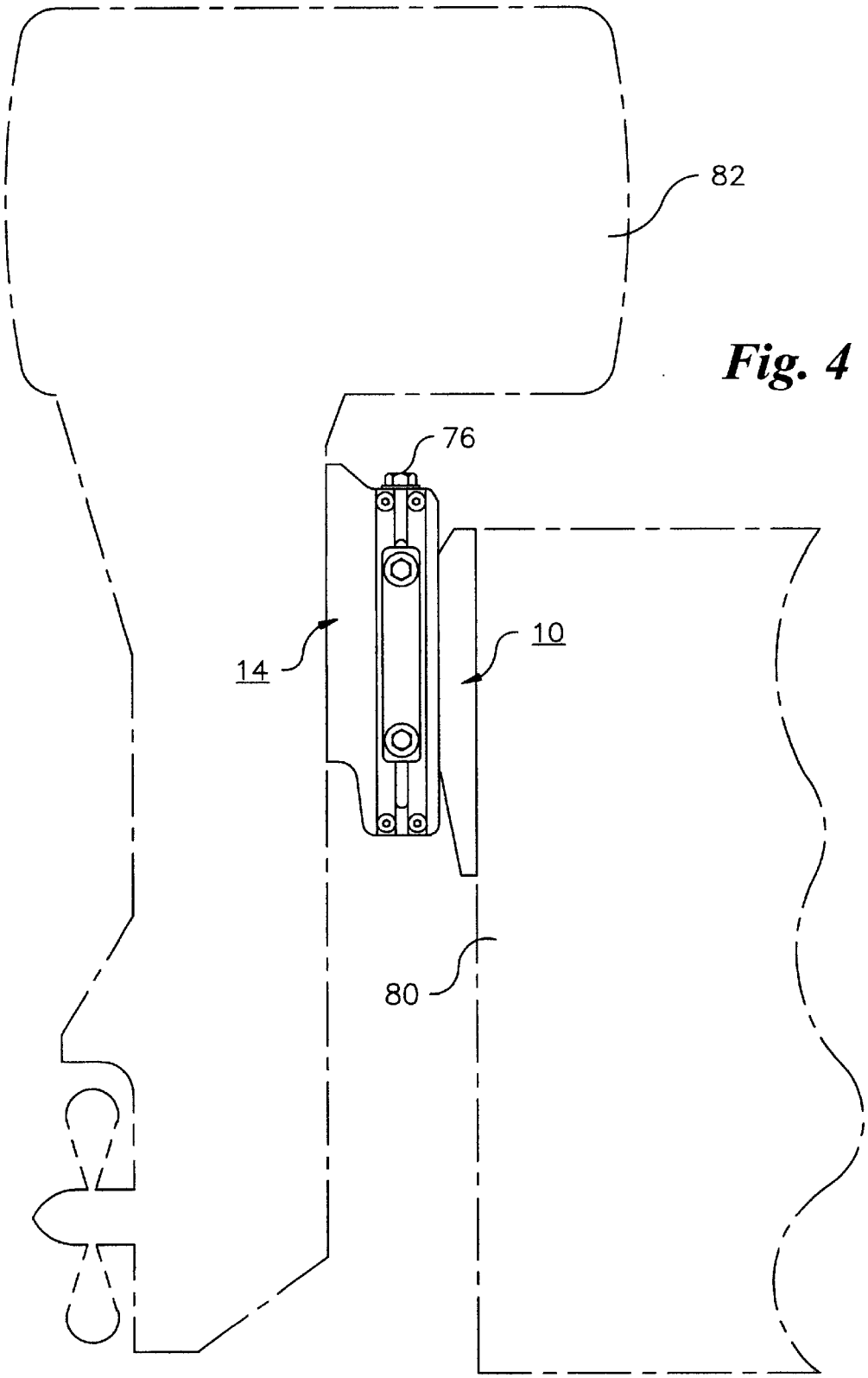
FIG. 4 is a side elevation showing the motor mount on the transom of a boat and supporting an outboard motor.

As will be apparent from FIG. 4, the bracket 10 and its counterpart 12 (not shown in FIG. 4) can be secured to the transom 80 of a boat while an outboard motor 82 can be secured to bracket 14 and its counterpart 16.

Still other modifications may be made to the apparatus and method described above without departing from the scope of the invention as defined in the following claims.

I claim:

1. A motor mount for adjustably supporting an outboard motor from a transom of a boat, the motor mount comprising:

first and second bracket assemblies;

means for connecting one of the bracket assemblies to a transom;

means for mounting an outboard motor to the other of the bracket assemblies; and means, connected to the first and second bracket assemblies, for effecting movement of the second bracket assembly relative to the first bracket assembly along a path, the path being substantially vertical when said one of the bracket assemblies is mounted on a transom;

in which the first bracket assembly comprises first and second brackets, each having a inner face and an upper and lower end, a first cross brace connected to the first and second brackets adjacent to their upper ends and a second cross brace connected to the first and second brackets adjacent to their lower ends;

in which the second bracket assembly comprises third and fourth brackets, each having an outer face and an upper and lower end, a third cross brace connected to the third and fourth brackets adjacent to their upper ends and a fourth cross brace connected to the third and fourth brackets adjacent to their lower ends;

in which the third and fourth cross braces are situated between the first and second cross braces and the spacing between the third and fourth cross braces is substantially less than the spacing between the first and second cross braces so that the bracket assemblies can move relative to each other through a range in said path; and in which the outer face of the third bracket is engaged with the inner face of the first bracket and the outer face of the fourth bracket is engaged with the inner face of the second bracket, and the engaging inner and outer faces of the brackets have interengaging ribs and recesses constraining the bracket assemblies to relative movement along said path; and in which the first, second, third and fourth brackets are formed from identical extrusions.

2. A motor mount according to claim 1, in which the inner face of the first bracket has a recess elongated in the direction of said path, the recess having a side surface extending transverse to said inner face of the first bracket, and in which the outer face of the third bracket has a rib elongated in the direction of said path, the rib having a side surface extending transverse to said outer face of the third bracket, said side surfaces being in sliding engagement with each other and preventing relative movement of the first and third brackets in at least one direction mutually parallel to their respective inner and outer faces and transverse to the direction of said path.

3. A motor mount for adjustably supporting an outboard motor from a transom of a boat, the motor mount comprising:

first and second bracket assemblies;

means for connecting one of the bracket assemblies to a transom;

means for mounting an outboard motor to the other of the bracket assemblies; and means, connected to the first and second bracket assemblies, for effecting movement of the second bracket assembly relative to the first bracket assembly along a path, the path being substantially vertical when said one of the bracket assemblies is mounted on a transom;

in which the first bracket assembly comprises first and second brackets, each having a inner face and an upper and lower end, a first cross brace connected to the first and second brackets adjacent to their upper ends and a second cross brace connected to the first and second brackets adjacent to their lower ends;

in which the second bracket assembly comprises third and fourth brackets, each having an outer face and an upper and lower end, a third cross brace connected to the third and fourth brackets adjacent to their upper ends and a fourth cross brace connected to the third and fourth brackets adjacent to their lower ends;

in which the third and fourth cross braces are situated between the first and second cross braces and the spacing between the third and fourth cross braces is substantially less than the spacing between the first and second cross braces so that the bracket assemblies can move relative to each other through a range in said path;

in which the outer face of the third bracket is engaged with the inner face of the first bracket and the outer face of the fourth bracket is engaged with the inner face of the second bracket, and the engaging inner and outer faces of the brackets have interengaging ribs and recesses constraining the bracket assemblies to relative movement along said path; and in which said recesses are situated on the inner faces of the first and second brackets, the first and second cross braces have ends received in said recesses, each of the recesses has at least one side surface extending transverse to the inner face of the bracket on which it is situated and in the direction of said path, and the first and second cross braces have faces in engagement with said side surfaces.

4. A motor mount according to claim 3, including screws extending through the first and second brackets in directions perpendicular to the inner faces of the first and second brackets adjacent to the upper and lower ends thereof, the screws adjacent to the upper ends of the first and second brackets being threaded into the first cross brace, and the screws adjacent to the lower ends of the first and second brackets being threaded into the second cross brace.

5. A motor mount for adjustably supporting an outboard motor from a transom of a boat, the motor mount comprising:

first and second bracket assemblies;

means for connecting one of the bracket assemblies to a transom;

means for mounting an outboard motor to the other of the bracket assemblies; and means, connected to the first and second bracket assemblies, for effecting movement of the second bracket assembly relative to the first bracket assembly along a path, the path being substantially vertical when said one of the bracket assemblies is mounted on a transom;

in which the first bracket assembly comprises first and second brackets, each having a inner face and an upper and lower end, a first cross brace connected to the first and second brackets adjacent to their upper ends and a second cross brace connected to the first and second brackets adjacent to their lower ends;

in which the second bracket assembly comprises third and fourth brackets, each having an outer face and an upper and lower end, a third cross brace connected to the third and fourth brackets adjacent to their upper ends and a fourth cross brace connected to the third and fourth brackets adjacent to their lower ends;

in which the third and fourth cross braces are situated between the first and second cross braces and the spacing between the third and fourth cross braces is substantially less than the spacing between the first and second cross braces so that the bracket assemblies can move relative to each other through a range in said path;

in which the outer face of the third bracket is engaged with the inner face of the first bracket and the outer face of the fourth bracket is engaged with the inner face of the second bracket, and the engaging inner and outer faces of the brackets have interengaging ribs and recesses constraining the bracket assemblies to relative movement along said path; and in which said recesses are situated on the inner faces of the first and second brackets, and the first and second cross braces have ends received in said recesses, and constrained thereby against movement in directions mutually parallel to the inner faces of the first and second bracket and transverse to said path.

6. A motor mount for adjustably supporting an outboard motor from a transom of a boat, the motor mount comprising:

first and second bracket assemblies;

means for connecting one of the bracket assemblies to a transom;

means for mounting an outboard motor to the other of the bracket assemblies; and means, connected to the first and second bracket assemblies, for effecting movement of the second bracket assembly relative to the first bracket assembly along a path, the path being substantially vertical when said one of the bracket assemblies is mounted on a transom;

in which the first bracket assembly comprises first and second brackets, each having a inner face and an upper and lower end, a first cross brace connected to the first and second brackets adjacent to their upper ends and a second cross brace connected to the first and second brackets adjacent to their lower ends;

in which the second bracket assembly comprises third and fourth brackets, each having an outer face and an upper and lower end, a third cross brace connected to the third and fourth brackets adjacent to their upper ends and a fourth cross brace connected to the third and fourth brackets adjacent to their lower ends;

in which the third and fourth cross braces are situated between the first and second cross braces and the spacing between the third and fourth cross braces is substantially less than the spacing between the first and second cross braces so that the bracket assemblies can move relative to each other through a range in said path;

in which the outer face of the third bracket is engaged with the inner face of the first bracket and the outer face of the fourth bracket is engaged with the inner face of the second bracket, and the engaging inner and outer faces of the brackets have interengaging ribs and recesses constraining the bracket assemblies to relative movement along said path; and in which each of the first and second brackets has an outer face opposite to its inner face and a slot extending from its outer face to its inner face, the slot being elongated in the direction of said path, and having a pair of elongated bars situated respectively against the outer faces of the first and second brackets, each bar having a rib slidably fitting into the slot of the bracket against the outer face of which the bar is situated, and including a pair of screw fasteners extending through each said bar and through an adjacent one of said slots and threaded into an adjacent one of said third and fourth brackets.

7. A motor mount for adjustably supporting an outboard motor from a transom of a boat, the motor mount comprising:

first and second bracket assemblies;

means for connecting one of the bracket assemblies to a transom;

means for mounting an outboard motor to the other of the bracket assemblies; and means, connected to the first and second bracket assemblies, for effecting movement of the second bracket assembly relative to the first bracket assembly along a path, the path being substantially vertical when said one of the bracket assemblies is mounted on a transom;

in which the first bracket assembly comprises first and second brackets, each having a inner face and an upper and lower end, a first cross brace connected to the first and second brackets adjacent to their upper ends and a second cross brace connected to the first and second brackets adjacent to their lower ends;

in which the second bracket assembly comprises third and fourth brackets, each having an outer face and an upper and lower end, a third cross brace connected to the third and fourth brackets adjacent to their upper ends and a fourth cross brace connected to the third and fourth brackets adjacent to their lower ends;

in which the third and fourth cross braces are situated between the first and second cross braces and the spacing between the third and fourth cross braces is substantially less than the spacing between the first and second cross braces so that the bracket assemblies can move relative to each other through a range in said path;

in which the outer face of the third bracket is engaged with the inner face of the first bracket and the outer face of the fourth bracket is engaged with the inner face of the second bracket, and the engaging inner and outer faces of the brackets have interengaging ribs and recesses constraining the bracket assemblies to relative movement along said path; and in which the first and second brackets have outer faces opposite to their inner faces, the third and fourth brackets have inner faces opposite to their outer faces, each of the first and second brackets has a slot extending from its outer face to its inner face, each slot having an upper and lower end and being elongated in the direction of said path, the first and second brackets have uniform and identical cross-sections in planes to which said path is perpendicular, from a location above the upper end of each slot to a location below the lower end of each slot, except for interruption by the slots, and the third and fourth brackets have cross sections, in planes to which said path is perpendicular, which are uniform and identical to said uniform cross-sections of the first and second brackets, from locations adjacent to the third cross brace to locations adjacent to the fourth cross brace.

8. A motor mount according to claim 1, in which the first, second, third and fourth brackets are formed by machining identical extrusions, and, except for the portions thereof removed by machining, have identical cross-sections.

* * * * *